United States Patent [19]

Asano et al.

[11] 4,349,581

[45] Sep. 14, 1982

[54] METHOD FOR FORMING AN ANTICORROSIVE COATING ON A METAL SUBSTRATE

[75] Inventors: Hiroshi Asano, Ichikawa; Takayuki Shimamune, Ichihara; Toshiki Goto, Ichihara; Hideo Nitta, Ichihara; Masashi Hosonuma, Ichihara, all of Japan

[73] Assignee: Permelec Electrode Ltd., Tokyo, Japan

[21] Appl. No.: 233,704

[22] Filed: Feb. 12, 1981

[30] Foreign Application Priority Data

Feb. 13, 1980 [JP] Japan ..... 55/15502

[51] Int. Cl.[3] ..... B05D 1/08

[52] U.S. Cl. ..... 427/34; 427/35; 427/53.1; 427/376.8; 427/423

[58] Field of Search ..... 427/34, 35, 229, 376.8, 427/53.1, 423

[56] References Cited

U.S. PATENT DOCUMENTS

| | | | |
|---|---|---|---|
| 3,265,526 | 8/1966 | Beer | 427/229 |
| 3,663,414 | 5/1972 | Martinsons et al. | 427/125 |
| 4,039,698 | 8/1977 | Fraser et al. | 427/229 |
| 4,145,481 | 3/1979 | Gupta et al. | 427/42 |
| 4,157,923 | 6/1979 | Yen et al. | 427/34 |
| 4,157,943 | 6/1979 | Scarpellino et al. | 427/229 |

*Primary Examiner*—John H. Newsome

*Attorney, Agent, or Firm*—Sughrue, Mion, Zinn, Macpeak & Seas

[57] ABSTRACT

A method for forming an anticorrosive coating on the surface of a metal substrate, which comprises, in one embodiment, (1) coating the surface of the metal substrate with an anticorrosive metal capable of forming an alloy with the substrate metal using a spraying procedure, and (2) then heating the coated surface in a vacuum or in an atmosphere substantially inert to the metal coating and metal substrate by irradiating electron beams or a plasma arc thereonto to form an alloy layer in the interface between the metal substrate and the metal coating and, in a second embodiment, subsequent to step (1) and prior to step (2) above coating a solution of a thermally decomposable platinum-group metal compound on the surface of the resulting coating, and heat-treating the coated product at about 50° to about 300° C.

7 Claims, 2 Drawing Figures

METHOD FOR FORMING AN ANTICORROSIVE COATING ON A METAL SUBSTRATE

FIELD OF THE INVENTION

This invention relates to a method for forming an anticorrosive metal coating on the surface of a metal substrate.

BACKGROUND OF THE INVENTION

Metallic materials are used in elemental form, as alloys or as composites in various mechanical devices, chemical devices, etc. depending on their physical and chemical properties. When they are used as parts requiring corrosion resistance, the surfaces of such parts only need to have sufficient corrosion resistance. It has been the practice therefore to coat the surface of a metal substrate with a material having superior corrosion resistance.

For example, it is known that titanium exhibits excellent corrosion resistance by forming a passive oxide film on the surface thereof. Thus, titanium has recently gained acceptance as a material for various machines, appliances and instruments such as chemical devices. In particular, in electrolysis apparatuses for sea water, saline water, etc., pure titanium has been used widely as a material for an electrolytic cell or a substrate of an insoluble metallic electrode. As such, however, crevice corrosion, etc. still tends to occur with pure titanium. The corrosion resistance of pure titanium is still not sufficient when titanium is used as an electrode substrate in electrolysis of strongly acidic electrolytic solutions containing hydrochloric acid sulfuric acid, etc. Attempts have therefore been made to coat the surface of titanium with platinum-group metals, such as palladium, or their alloys, or anticorrosive metals such as tantalum or niobium and their alloys.

Various methods have been suggested to date for forming a coating of an anticorrosive metal on the surface of a metal substrate. For example, Japanese Patent Publication No. 415/68 and Japanese Patent Application (OPI) No. 19672/75 disclose a method for preventing crevice corrosion by bonding a titanium-palladium alloy material to a titanium substrate by welding, and the like. Bonding by welding, however, requires a high level of welding skill. It is difficult to apply this method to materials with a complex profile, and the strength of adhesion of such a material to the substrate is not entirely satisfactory.

On the other hand, various methods are known for depositing an anticorrosive material on the surface of a metal substrate by electroplating, chemical (electroless) plating, thermal decomposition, spraying, vacuum deposition, etc., to coat the surface with such a material, and heat-treating the coated substrate (see, for example, Japanese Patent Publication Nos. 12882/71, 2669/73 and 24136/73, and Japanese Patent Application (OPI) Nos. 25636/73, 40676/73, and 4736/78). According to these methods, the thickness of the coating can be made as thin as is required. However, formation of micropores in the coated layer cannot be avoided, and heat-treatment must be performed in a vacuum, etc., for a long period of time. Because of these difficulties, the prior art methods have been unable to provide products having a high degree of corrosion resistance and satisfactory adhesion of the coated layer to the substrate.

SUMMARY OF THE INVENTION

An object of this invention is to overcome the above-described difficulties of the prior art, and to provide a method for easily forming a compact anticorrosive metal coating having high adhesion and excellent corrosion resistance on the surface of a metal substrate.

Accordingly this invention in one embodiment provides a method for forming an anticorrosive coating on the surface of a metal substrate, which comprises (1) coating the surface of the metal substrate with an anticorrosive metal capable of forming an alloy with the substrate metal using a spraying procedure, and (2) then heating the coated surface in a vacuum or in an atmosphere substantially inert to the metal coating and metal substrate by irradiating electron beams or a plasma arc thereonto to form an alloy layer in the interface between the metal substrate and the metal coating.

According to another embodiment of this invention, there is provided a method for forming an anticorrosive coating on the surface of a metal substrate which comprises subsequent to step (1) and prior to step (2)

additionally coating a solution of a thermally decomposable platinum-group metal compound on the surface of the resulting coating and heat-treating the coated product at about 50° to about 300° C.

DETAILED DESCRIPTION OF THE INVENTION

Figure 1:
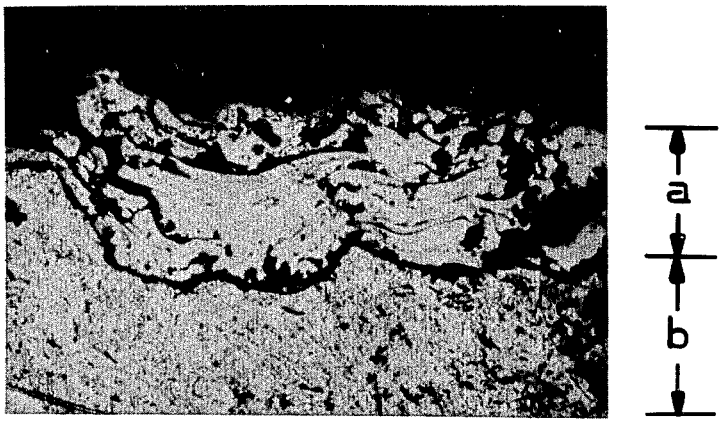
FIG. 1 is an enlarged photograph (200×) of a partial cross-section of a titanium plate coated with tantalum by plasma spraying.

In accordance with this invention, the above-described object is achieved by embodiments of the methods of this invention. The invention results in the particular advantage that a firmly adherent anticorrosive metal coating can be easily formed on the surface of a metal substrate which has insufficient corrosion resistance by forming an alloy layer in the interface between the metal substrate and the metal coating. Furthermore, in accordance with this invention, since coating of an anticorrosive metal is performed by plasma spraying, etc., and the heat-treatment of the coating is performed by using a high-energy source such as electron beams, high-melting metals having a melting point of about 2500° C. or higher, such as tungsten, molybdenum, tantalum and niobium, can be easily employed and the coating treatment can be completed within a very short period of time. The method of this invention does not require long-term high-temperature heat-treatment as in the prior art methods, and adverse oxidative or thermal effects on the substrate or metal coating can be markedly reduced. Another advantage of this invention is that even after assembly of a certain device, a part of the device, as required, may be coated by the method of this invention. The metal coating obtained by the method of this invention is compact and has sufficient corrosion resistance. Because the metallic coating is formed by a spraying method, the coated surface has a moderate degree of roughness, and good adhesion to the coated surface can be achieved by an electrode active substance which might be coated thereon. Accordingly, the coated metal substrate in accordance with this invention is especially suitable for use as an electrolytic electrode or an electrode substrate.

The metal substrate which can be used in this invention may be any of those metal materials which are generally used in various apparatuses, appliances and instruments, and the metal substrate is not limited in particular. Suitable metal substrates include for example, structural materials, electrically conductive materials, valve metals with corrosion resistance such as titanium, tantalum, zirconium and niobium, alloys composed mainly, e.g., containing more than about 50% by weight, of these valve metals, e.g. Ti-Ta alloys, Ti-Ta-Nb alloys, Ti-Ta-Zr alloys, Ti-Pd alloys, etc., and low-cost metal materials with good workability, such as iron, nickel, cobalt, copper or alloys composed mainly, e.g., containing more than about 50% by weight, of these metals, e.g., carbon steel, stainless steel, Ni-Cu alloys, brass, etc. When the final coated product is to be used as an electrolytic electrode or a substrate therefor, titanium can be suitably used as an anode, and titanium, iron, and nickel can be suitably used as a cathode. Low-melting metals such as aluminum and lead can also be used, but are less preferred because these metals are easily melted by the heat-treatment involving irradiation of electron beams, etc.

Suitable metals which can be coated on the surface of the substrate metal are any of those metals which have excellent corrosion resistance and can be alloyed with the substrate metal. Suitable coating metals include tantalum, zirconium, niobium, titanium, molybdenum, tungsten, vanadium, chromium, nickel, silicon, and alloys composed mainly of these metals. When such an anticorrosive coating metal also has electrode activity, the resulting metal-coated product in accordance with this invention can be directly used as an electrode. An example of such is a cathode for electrolysis of an aqueous solution comprising iron coated with nickel or tungsten. Suitable combinations of the substrate metal and the coating metal are, for example, a combination of a titanium or zirconium substrate and a tantalum or tungsten coating, and a combination of an iron or nickel substrate and a titanium, tantalum, niobium, zirconium or molybdenum coating. Although some of the substrate metals and coating metals described above are the same, it will be obvious from disclosure herein that the substrate metal and the coating metal employed differ in use.

Coating of the anticorrosive metal on the surface of the metal substrate is performed by a spraying method. Plasma spraying is preferred as the spraying method, but explosive flame spraying or high-temperature gas spraying can also be used. Known spraying means described, for example, in Japanese Patent Application (OPI) Nos. 40676/73 and 46581/76 can be employed. Suitable spraying techniques are also described in, for example, *Advances in Surface Coating Technology,* Vol. I, 1978, the Welding Institute.

After coating the metal substrate with the anticorrosive metal by spraying, the coated surface is heated by exposing to irradiation with electron beams or a plasma arc to form an alloy layer in the interface between the metal substrate and the metal coating. On irradiation with electron beams or a plasma arc, the coated surface is instantaneously heated to a high temperature by the high energy of such an irradiation source, and metal atoms diffuse together and melt-adhere in the interface between the metal substrate and the metal coating to form a compact alloy layer which is considered to provide film adhesion between the substrate metal and the metal coating. The thickness of the alloy layer formed is on the order of about $1\mu$ or more.

Irradiation with electron beams or a plasma arc can be performed employing conventional means used in welding or the like. In the method of this invention, such conventional means may be performed by using appropriate choices of irradiation conditions such as the intensity of the irradiation and the irradiation time, which provide the energy required for alloying at the interface, depending upon the types of metals used. By such means, the coated surface can be easily heated to about 1000° to 2000° C. For example, the means described in Japanese Patent Application (OPI) No. 20988/77, D. R. Dreger, "Pinpoint Hardening by Electron Beams", 89, Oct. 26, 1978, *Machine Design* and "Heat Treating in a Flash", 56, Nov. 1978, *Production,* can be used.

Irradiation with electron beams or a plasma arc should be effected in a vacuum or in an atmosphere (substantially) inert to the coated metal (and metal substrate) during the irradiation treatment. The terms "vacuum" or "substantially inert atmosphere", as used in this application denotes any atmosphere which does not impede irradiation of electron beams or a plasma arc, and does not cause any difficulties due to the reaction of gas in the atmosphere with the metal coating during the irradiation treatment. Thus, sometimes, air may be employed and is included within this definition. Preferably, electron beams are irradiated in a vacuum at a degree of vacuum of about $10^{-2}$ to $10^{-7}$ torr.

In one embodiment of the method of this invention, before the surface of the metal coating formed by spraying is subjected to irradiation with electron beams or a plasma arc, an additional step is performed which comprises coating a solution of a thermally decomposable platinum-group metal compound on the metal coating surface and heating such to about 50° C. to 300° C. By performing this additional step, the platinum-group metal compound penetrates into the micropores or interspaces present in the sprayed metal coating, and the platinum-group metal with corrosion resistance resulting from thermal decomposition and reduction of the platinum-group metal compound by electron beam irradiation, etc., is embedded in the metal coating. Thus, the metal coating becomes more compact, and the corrosion resistance of the metal coating is further improved.

Examples of the thermally decomposable, generally at about 300° C. or higher, platinum-group metal compounds which can be used include halogen-compounds or organic compounds of platinum, ruthenium, iridium, palladium or rhodium, or mixtures thereof. Suitable specific examples of such compounds include $RuCl_3$, $RuCl_4$, $H_2PtCl_6$, platinum metal resinates (e.g., those of Pt, Ir, Ru, etc.). Such compounds can be used as a solution in a suitable solvent. Solutions of such compounds are well known in manufacturing insoluble metal electrodes, and are described in detail in Japanese Patent Publication No. 3954/73 corresponding to U.S. Pat. No. 3,711,385. The heating in this step is intended mainly for removing the solvent of the coating solution, can usually be achieved satisfactorily at about 50° to 300° C. and can generally be accomplished in an oven, electric furnace, and the like.

The following Examples are given to illustrate the present invention more specifically. It should be understood that these examples are not in any way intended to be interpreted as limiting the scope of the present invention.

EXAMPLE 1

The surface of a commercially available pure titanium plate (50 mm×50 mm×1.5 mm) was degreased and cleaned. Tantalum powder, mostly of particles having a particle size of 30 to 90μ was applied to the cleaned surface of the titanium plate by plasma spraying under the conditions shown in Table 1 below. Thus, a tantalum coated layer having a thickness of about 100μ was formed on the surface of the titanium plate.

TABLE 1

| Plasma Spraying Conditions | | |
|---|---|---|
| Flow Rate of Plasma Gases | Ar | 30 liters/min. |
| | $H_2$ | 6 liters/min. |
| Flow Rate of Carrier Gas | Ar | 6 liters/min. |
| Amount of Tantalum Powder Fed | | 50 g/min. |
| Current | | 550 A |
| Spraying Distance | | 100 mm |

The tantalum-coated surface of the titanium plate was then exposed to irradiation of electron beams in a vacuum ($10^{-4}$ torr) under the conditions shown in Table 2 below

TABLE 2

| Electron Beam Irradiating Conditions | |
|---|---|
| Voltage | 12 KV |
| Current | 0.4 A |
| Sample Moving Speed | 10 mm/sec. |
| Irradiation | 1.2 m |
| Electron Beam Diameter | 20 mm |

FIG. 1 of the accompanying drawings shows an enlarged photograph in section of the tantalum-coated surface of the titanium plate before irradiation with electron beams. A number of pores can be seen in the coated layer a, and the adhesion between the substrate b and the coated layer a is insufficient.

Figure 2:
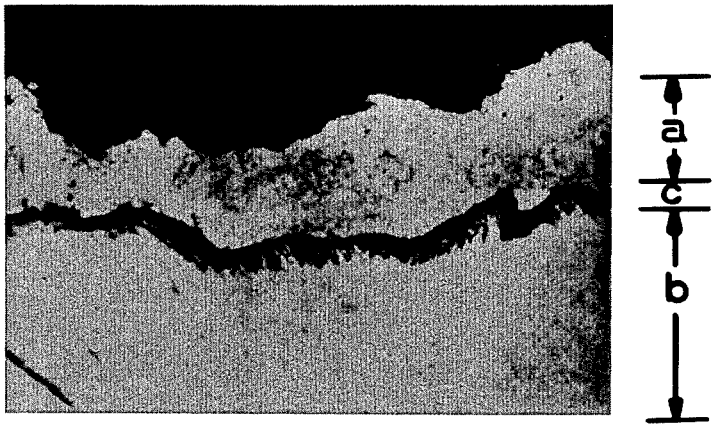
FIG. 2 is an enlarged photograph (200×) of a partial cross-section of a titanium plate coated with tantalum by plasma spraying and then exposed to irradiation of electron beams.

FIG. 2 is an enlarged photograph in cross section of the tantalum-coated surface of the titanium plate which was irradiated with electron beams in accordance with this invention. It can be seen from the photograph that substantially no pores are present in the coated layer a and an alloy layer c of titanium and tantalum is formed between the titanium substrate b and the tantalum coating a, thus exhibiting a firm adhesion between the substrate and the coating. Formation of the alloy layer c was also confirmed by analysis with an X-ray microanalyzer. Analysis by X-ray diffraction showed that the oxide present in considerable amounts in the plasma-sprayed tantalum layer before irradiation of electron beams had mostly disappeared after the irradiation with electron beams.

The resulting samples were subjected to corrosion resistance testing under the conditions shown in Table 3 below

TABLE 3

| Corrosion Resistance Test Conditions | |
|---|---|
| Corrosive Solution | 25% Aqueous solution of hydrochloric acid |
| Temperature | Boiling point |

TABLE 3-continued

| Corrosion Resistance Test Conditions | |
|---|---|
| Time | 10 Minutes |

The sample in accordance with this invention obtained after electron beam irradiation showed a weight loss of 3.6 mg/cm$^2$, while the comparative sample not so subjected to electron beam irradiation showed a weight loss of 9.6 mg/cm$^2$. Thus, this demonstrated that the coated metal substrate in accordance with this invention has markedly improved corrosion resistance.

EXAMPLE 2

In the same manner as described in Example 1, tantalum was coated by plasma spraying on a titanium plate, and the coated surface was exposed to irradiation with electron beams. The resulting coated plate was used as an electrode substrate, and pickled in a dilute aqueous solution of hydrofluoric acid. Then a coating of platinum with a thickness of 3μ was formed on the electrode substrate by electroplating from a platinum plating bath to form an electrode.

The electrode obtained was used as an anode, and subjected to electrolysis testing under the conditions shown in Table 4 below

TABLE 4

| Electrolysis Test Conditions | |
|---|---|
| Electrolytic Solution | Aqueous solution of sulfuric acid (1 mole/liter) |
| Current Density | 50 A/dm$^2$ |
| Temperature | 80° C. |

For comparison, platinum was electroplated directly on a titanium substrate to a thickness of 3μ in the same manner as above to form an electrode (comparison 1). Also, a platinum coating having a thickness of 3μ was electroplated in the same manner as above on a titanium plate having thereon a plasma-sprayed tantalum coating which had not been exposed to irradiation with electron beams to form another electrode (comparison 2). These comparison electrodes were also subjected to the same electrolysis testing.

The electrode produced from the substrate obtained in accordance with this invention showed a service life of more than 1000 hours. On the other hand, an increase in electrolysis voltage occurred in about 500 hours for the comparison electrode (comparison 1) and the electrode became passive. In the other comparison electrode (comparison 2), peeling occurred between the platinum plated layer and the tantalum coated layer in about 50 hours, making it impossible to continue the electrolysis.

It can be seen from the above results that the plasma-sprayed and the electron beam-irradiated coated layer of the metal-coated substrate in accordance with this invention has very good adhesion and corrosion resistance, and such a material fully withstands use as a substrate for electrodes in electrolyzing strongly acidic electrolyte solutions.

EXAMPLE 3

The surface of a tantalum-coated titanium plate produced under the conditions shown in Table 1, Example 1 was exposed to the irradiation of a plasma arc in argon gas under the conditions shown in Table 5 below using a commercially available plasma welding machine.

TABLE 5

| Plasma Arc Irradiation Conditions | |
|---|---|
| Pressure of Argon Gas | 2 kg/cm$^2$ |
| Current | 70–80 A |
| Irradiation Time | 5–10 seconds |

The resulting plasma arc-irradiated tantalum-coated titanium plate was used as an electrode substrate, and coated with an electrode coating solution shown in Table 6 below and baked in air at 500° C. to produce an electrode.

TABLE 6

| Electrode Coating Solution | |
|---|---|
| Iridium Trichloride | 2 g |
| Titanium Trichloride | 1.5 g |
| 5% Aqueous Solution of Hydrochloric Acid | 5 cc |

For comparison, a tantalum-coated titanium plate produced as above but not exposed to the plasma arc irradiation but rather coated directly with the same electrode coating solution as in Table 6 above, followed by baking under the same conditions as above was prepared.

The resulting electrodes were used as anodes, and subjected to an electrolysis testing under the conditions shown in Table 7 below. A carbon plate was used as a cathode.

TABLE 7

| Electrolysis Test Conditions | |
|---|---|
| Electrolyte Solution | 10% Aqueous solution of sulfuric acid |
| Current Density | 15 A/dm$^2$ |
| Temperature | 40–50° C. |

With the electrode produced from the substrate obtained by the method of this invention, no appreciable increase in electrolysis voltage was observed after it was used in electrolysis for 6 months. But an increase in electrolysis voltage occurred with the comparative electrode in about 1 month.

EXAMPLE 4

A tantalum-coated titanium plate produced under the conditions shown in Table 1, Example 1 was coated with a ruthenium trichloride solution of the composition shown in Table 8, below and heated in air at 150° C. for 10 minutes.

TABLE 8

| Ruthenium Trichloride Solution | |
|---|---|
| Ruthenium Trichloride | 3 g |
| 5% Aqueous Solution of Hydrochloric Acid | 8 cc |

The coated surface was then exposed to electron beam irradiation under the conditions shown in Table 2, Example 1 to decompose the ruthenium trichloride and form an alloy layer in the interface between the substrate and the coated layer.

The resulting coated titanium plate was used as an electrode substrate, coated with an electrode coating solution of the composition shown in Table 9 below, and baked at 450° C. in air to produce an electrode. For comparison, the above procedure was repeated except that the coating with the ruthenium trichloride was not performed.

Each of the resulting electrodes was used as an anode, and subjected to electrolysis testing under the conditions shown in Table 10 below. A carbon plate was used as a cathode.

TABLE 9

| Electrode Coating Solution | |
|---|---|
| Ruthenium Trichloride | 1 g |
| Titanium Trichloride | 1.5 g |
| 5% Aqueous Solution of Hydrochloric Acid | 15 cc |

TABLE 10

| Electrolysis Test Conditions | |
|---|---|
| Electrolyte Solutions | 3% Aqueous solution of sodium chloride<br>10% Aqueous solution of hydrochloric acid |
| Current Density | 150 A/dm$^2$ |
| Temperature | 90° C. |

No increase in voltage was seen in the ruthenium-coated electrode after it was subjected to electrolysis for 3 months. However, with the comparative electrode, an increase in voltage of about 0.5 V was observed after a lapse of three months. This demonstrates therefore that the corrosion resistance of the electrode was improved by using the ruthenium coated, electron beam-irradiated electrode substrate.

EXAMPLE 5

A titanium plate coated with tantalum by plasma spraying under the conditions shown in Table 1, Example 1 was coated with an iridium trichloride solution of the composition shown in Table 11 below and heated in air at 150° C. for 10 minutes.

TABLE 11

| Iridium Trichloride Solution | |
|---|---|
| Iridium Trichloride | 3 g |
| 5% Aqueous Solution of Hydrochloric Acid | 8 cc |

The coated product was then exposed to irradiation of electron beams under the conditions shown in Table 2, Example 1. Furthermore, the same iridium trichloride solution as shown in Table 11 was coated on the resulting product and baked in air at 500° C. for 10 minutes to obtain an electrode coated with iridium oxide.

For comparison, the same type of titanium substrate produced as above was directly coated with the electrode coating solution shown in Table 11, followed by baking.

Each of the resulting electrodes was used as an anode, and subjected to electrolysis testing under the conditions shown in Table 12 below. A carbon plate was used as a cathode.

TABLE 12

| Electrolysis Test Conditions | |
|---|---|
| Electrolyte Solution | Aqueous solution of sulfuric acid (1 mole/liter) |
| Current Density | 50 A/dm$^2$ |
| Temperature | 90° C. |

An increase in voltage after electrolysis for 120 hours, was observed for the comparative electrode and the electrolysis could not be continued any longer. In contrast, the electrode produced from the substrate in accordance with this invention showed a voltage increase of about 0.1 V after a lapse of 500 hours, and the electrolysis could be continued.

EXAMPLE 6

The surface of a mild steel plate (SS-41; 50 mm×50 mm×1.5 mm) was degreased, and titanium powder, mostly of particles having a particle size of 75 to 30μ was plasma-sprayed on the degreased surface under the conditions shown in Table 13 below to form a titanium coating having a thickness of about 100μ on the mild steel plate.

TABLE 13

| Plasma Spraying Conditions | | |
|---|---|---|
| Flow Rates of Plasma Gases | Ar | 30 liters/min. |
| | $H_2$ | 6 liters/min. |
| Flow Rate of Carrier Gas | Ar | 6 liters/min. |
| Amount of Titanium Powder Fed | | 50 g/min. |
| Current | | 550 A |
| Spraying Distance | | 100 mm |

The surface of the titanium-coated mild steel plate was then exposed to irradiation of electron beams under the conditions shown in Table 14 below.

TABLE 14

| Electron Beam Irradiation Conditions | |
|---|---|
| Voltage | 100 KV |
| Current | 15 mA |
| Irradiation Distance | 1.0 m |
| Electron Beam Diameter | 2 mm |

After irradiation with the electron beams, the number of pores in the plasma-sprayed titanium coating was reduced, and an alloy layer having a thickness of about 10μ was formed in the interface between the mild steel plate and the titanium coating. The titanium coating adhered firmly to the mild steel substrate.

The resulting coated mild steel substrate was subjected to corrosion resistance testing under the conditions shown in Table 15 below. For comparion, a sample (Comparison 1) obtained by spraying titanium on a mild steel plate to a thickness of about 100μ, and the mild steel plate itself (Comparison 2) were also subjected to the same corrosion resistance testing.

TABLE 15

| Corrosion Resistance Test Conditions | |
|---|---|
| Corrosive Solution | 25% Aqueous solution of hydrochloric acid |
| Temperature | 80° C. |
| Time | 10 Minutes |

The coated substrate obtained in accordance with this invention showed a weight loss of 6.7% mg/cm$^2$. But the Comparison 1 sample showed a weight loss of 23.0 mg/cm$^2$, and the Comparison 2 sample showed a weight loss of 58.0 mg/cm$^2$. The results show that the corrosion resistance of the plasma-sprayed substrate was markedly improved by irradiation with electron beams.

EXAMPLE 7

A mild steel plate coated with titanium by plasma spraying was produced under the conditions shown in Table 13, Example 6. The surface of the coated plate was coated with a ruthenium trichloride solution having the composition shown in Table 16 below and heated in air at 150° C. for 10 minutes.

TABLE 16

| Ruthenium Trichloride Solution | |
|---|---|
| Ruthenium Trichloride | 3 g |
| 36% Aqueous Solution of Hydrochloric Acid | 5 cc |
| n-Butanol | 5 cc |

The surface of the coated product was exposed to irradiation of electron beams under the conditions shown in Table 14, Example 6 to decompose the ruthenium trichloride and form an alloy layer in the interface between the substrate and the coating. The resulting product was used as an electrode substrate, coated with an electrode coating solution of the composition shown in Table 17, below and baked in air at 500° C. for 10 minutes to form an electrode having an oxide coating.

TABLE 17

| Electrode Coating Solution | |
|---|---|
| Ruthenium Trichloride | 1 g |
| Iridium Trichloride | 1 g |
| Titanium Trichloride | 1.5 g |
| 36% Aqueous Solution of Hydrochloric Acid | 5 cc |
| n-Butanol | 10 cc |

For comparison, the above procedure was repeated except that the ruthenium trichloride solution shown in Table 16 was not coated to form an electrode.

Each of these electrodes was used as an anode, and subjected to electrolysis testing under the same conditions as shown in Table 10, Example 4. A carbon plate was used as a cathode.

The electrode produced from the substrate in accordance with this invention showed no increase in electrolysis voltage after it was used in electrolysis for 2 months. But a voltage increase of about 2 V was observed for the comparative electrode after a lapse of 2 months. Thus, it can be seen that by applying a ruthenium coating and then exposing the coated surface to electron beam irradiation, the corrosion resistance of the coated substrate was improved.

While the invention has been described in detail and with reference to specific embodiments thereof, it will be apparent to one skilled in the art that various changes and modifications can be made therein without departing from the spirit and scope thereof.

What is claimed is:

1. A method for forming an anticorrosive coating on the surface of a metal substrate, which comprises the steps of (1) coating the surface of a metal substrate with an anticorrosive metal capable of forming an alloy with said substrate metal by a spraying procedure, and (2) then heating the coated surface in a vacuum or in a substantially inert atmosphere by irradiating the surface with electron beams or a plasma arc to form an alloy layer only in the interface between said metal substrate and said metal coating.

2. The method of claim 1 wherein the method comprises subsequent to step (1) and prior to step (2)

coating a solution of a thermally decomposable platinum-group metal compound on the surface of the resulting coating, and heat-treating the coated product at about 50° to about 300° C.

3. The method of claim 1 or 2, wherein said metal substrate is a substrate of titanium, tantalum, zirconium or niobium, or an alloy composed mainly of any one of these metals.

4. The method of claim 1 or 2, wherein said metal substrate is a substrate of iron, nickel, cobalt or copper, or an alloy composed mainly of any one of these metals.

5. The method of claim 1 or 2, wherein said anticorrosive metal is tantalum, zirconium, niobium, titanium, molybdenum, tungsten, vanadium, chromium, nickel or silicon, or an alloy composed mainly of any one of these metals.

6. The method of claim 2, wherein said platinum-group metal compound is a halogen-containing compound of or an organic compound of platinum, iridium, ruthenium, palladium or rhodium, or a mixture thereof.

7. The method of claim 1, wherein the irradiation of the surface with electron beams or plasma arc is with an intensity sufficient to form said alloy layer only in the interface between said metal substrate and said metal coating.

* * * * *